US008120629B2

(12) United States Patent
Maruyama et al.

(10) Patent No.: US 8,120,629 B2
(45) Date of Patent: Feb. 21, 2012

(54) DISPLAY DEVICE

(75) Inventors: Junichi Maruyama, Yokohama (JP); Yoshihisa Ooishi, Yokohama (JP); Yoshiki Kurokawa, Tokyo (JP); Takashi Shoji, Fujisawa (JP); Kikuo Ono, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1049 days.

(21) Appl. No.: 12/028,099

(22) Filed: Feb. 8, 2008

(65) Prior Publication Data

US 2008/0198185 A1 Aug. 21, 2008

(30) Foreign Application Priority Data

Feb. 9, 2007 (JP) ..... 2007-030356

(51) Int. Cl.
*G09G 5/02* (2006.01)

(52) U.S. Cl. ..... 345/698; 345/694

(58) Field of Classification Search ..... 345/30, 345/77, 204, 589, 44; 313/504
See application file for complete search history.

(56) References Cited

U.S. PATENT DOCUMENTS

| | | | | |
|---|---|---|---|---|
| 2004/0027313 | A1* | 2/2004 | Pate et al. | 345/30 |
| 2004/0233185 | A1* | 11/2004 | Hashimoto et al. | 345/204 |
| 2005/0001542 | A1* | 1/2005 | Kiguchi | 313/504 |
| 2006/0082525 | A1* | 4/2006 | Suzuki et al. | 345/77 |
| 2006/0221092 | A1* | 10/2006 | Noguchi et al. | 345/589 |

FOREIGN PATENT DOCUMENTS

| | | |
|---|---|---|
| JP | 2000-165664 | 6/2000 |
| JP | 2002-215082 | 7/2002 |

* cited by examiner

*Primary Examiner* — Quan-Zhen Wang
*Assistant Examiner* — Troy Dalrymple
(74) *Attorney, Agent, or Firm* — Antonelli, Terry, Stout & Kraus, LLP.

(57) ABSTRACT

A signal converter to make a display module conduct an n-ply display operation divides one frame period of input display data into n subframes to obtain n-ply display data, shifts the sampling position for each n-ply display data, samples the data to convert resolution thereof, rearranges in n ways a combination of subpixels included in each pixel of output display data resultant from the sampling, and varying the sampling position and the combination of subpixels for each subframe in a cooperative fashion.

10 Claims, 9 Drawing Sheets

DISPLAY DEVICE

INCORPORATION BY REFERENCE

The present application claims priority from Japanese application serial no. 2007-030356 filed on Feb. 9, 2007, the contents of which is hereby incorporated by reference into this application.

BACKGROUND OF THE INVENTION

The present invention relates to display device including fixed pixels such as a Liquid-Crystal Display (LCD), an organic Electro Luminescence (EL) display, a projection display, and a Field Emission Display (FED).

To display color images on a display device or display including fixed pixels arranged in a matrix such as an LCD or a PDP, there is widely employed a method in which each pixel includes three subpixels, i.e., red (R), green (G), and blue (B) subpixels and luminance of each of the R, G, B subpixels is independently controlled. To display color images on a fixed-pixel display including p×q pixels (p and q are natural numbers; resolution), input display data is produced also with a resolution of p×q in general.

If the input display data has a resolution of P×Q (P and Q are natural numbers) and there exists a relationship of $p \leqq P$ or $q \leqq Q$, it is required to conduct data reduction. For the reduction, JP-A-2000-165664 describes a method of configuring a reduction circuit including an up-sampler, a filter, and a down-sampler.

To display fine images with higher resolution, JP-A-2002-215082 describes a method in which each frame is divided into two fields and the combination of subpixels is changed in the respective fields.

SUMMARY OF THE INVENTION

To display images by conducting the reduction in a fixed-pixel display, part of information of input display data is lost through resolution conversion, and hence less fine images are perceived by the viewer. In the method in which the combination of subpixels is changed in the two fields, it is required to change the subpixel area in area size.

According to an aspect of the present invention, there are disposed a module which makes a fixed-pixel display device including a plurality of n subpixels display images at n times the original speed, a module to displace or to shift the sampling position for each of n subframes, and a module which rearranges the combination of subpixels constituting one pixel in n ways to thereby change the sampling position and the combination of subpixels for each subframe in a cooperative fashion.

According to the present invention as above, when displaying images using the reduction on a display including a fixed number of pixels, it is possible to reduce the amount of information items of display data lost through the resolution conversion to thereby improve fineness of images perceived by the viewer. Assume, for example, that display data of full High Definition (FD) resolution (1920×1080) is inputted to a display of Wide extended Graphics Array (WXGA; 1366×768) resolution. It is possible in this situation that the viewer perceives the images with fineness equal to or more than that of the WXGA resolution.

Other objects, features and advantages of the invention will become apparent from the following description of the embodiments of the invention taken in conjunction with the accompanying drawings.

DESCRIPTION OF THE EMBODIMENTS

Figure 1A:
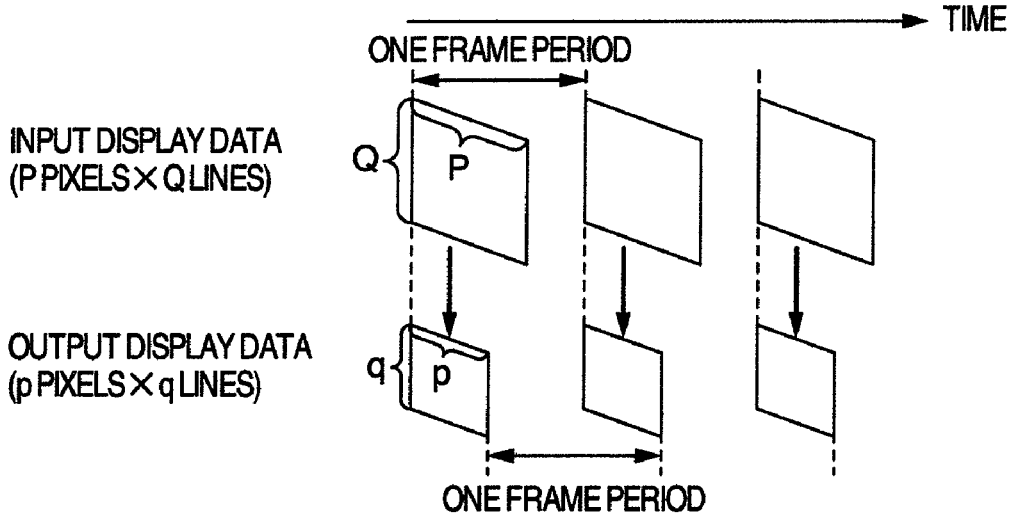
FIGS. 1A and 1B are schematic diagrams to explain a concept of the reduction processing in a fixed-pixel display.

Referring now to the drawings, description will be given of a configuration of a display device or display according to the present invention. First, an outline of operation of a conventional display will be described by referring to FIGS. 1A, 1B, 2A, 2B, and 3. Thereafter, an outline of operation of the display according to the present invention will be described by referring to FIGS. 1A and 1B, FIGS. 4A to 4D, FIG. 5. Additionally, description will be given of a first embodiment of the present invention by referring FIGS. 5 and 6 and FIGS. 7A to 7C. Moreover, referring to FIGS. 8A to 8C, FIGS. 9A to 9F, FIGS. 10A to 10D, FIGS. 11A to 11F, FIGS. 12A and 12B, and FIGS. 13A to 13F, description will be given of second to seventh embodiments according to the present invention. The second to seventh embodiments differ from each other in the method of arranging subpixels of the display. In the description of a module to display input display data by multiplying the data by n, the value of n is set to three. However, the value is not limited to three, but it is possible set n to any appropriate value.

First Embodiment

Figure 1B:
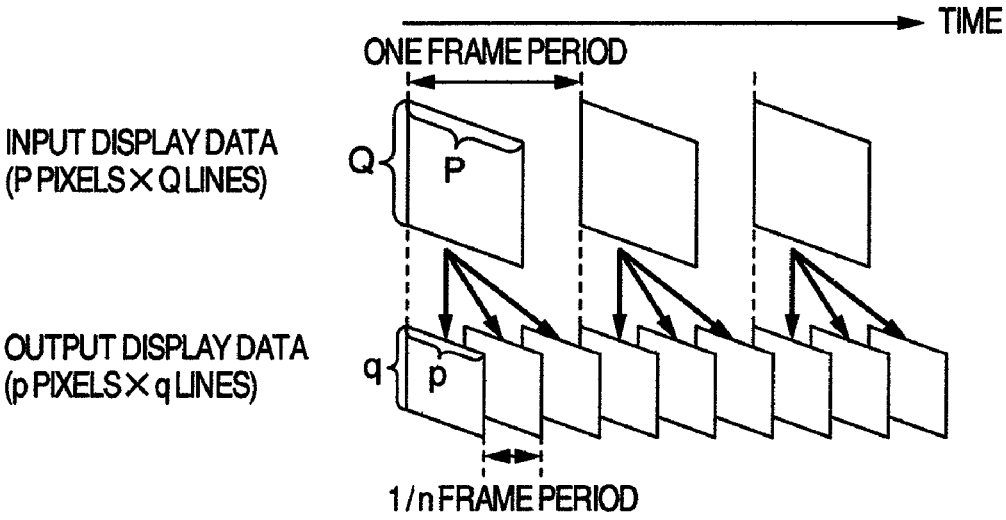

FIGS. 1A and 1B show a concept of the reduction processing in a fixed-pixel display in which the number of pixels used to display an image is fixed. Hereinbelow, a display indicates a fixed-pixel display unless otherwise noticed or specified. FIG. 1A shows a concept of the conventional reduction processing. FIG. 1B shows a concept of the reduction processing in accordance with the present invention. In FIGS. 1A and 1B, the abscissa represents a lapse of time.

In FIG. 1A, input display data having a resolution represented as P pixels×Q lines (P and Q are natural numbers) is sequentially inputted during each frame period. For example, one frame period is 16.6 milliseconds for video data in television signals conforming to National Television System Committee (NTSC) standards. The frame frequency is 60 hertz (Hz) in this case.

For the input display data, the resolution conversion processing is sequentially executed, for example, filtering, sampling rate conversion, and the like are conducted to produce output display data including p pixels×q lines (p and q are natural numbers satisfying p≦P and q≦Q). The output display data is displayed on various kinds of displays. In the system, one frame period of output display data and one frame period of input display data are kept fixed.

In the conventional display, fineness of images perceived by the viewer is determined by the number of pixels (p pixels×q lines) of the display as described above. In contrast thereto, in the display of the present invention, for the input display data, the display operation is conducted n times during one frame period as shown in FIG. 1B. That is, the frame frequency is multiplied by n for the output display data. The display data update interval is then 1/n of frame period. Each frame used for the n display operations will be referred to as a subframe hereinbelow.

According to the present invention, the display is driven such that mutually different resolution conversion processings are executed for n subframes to thereby display the n subframes at a speed which is n times the original speed. According to the resolution conversion processings, the display of the present invention is capable of making the viewer perceive displayed images with fineness equal to or more than that obtained according to the actual number of pixels (p pixels×q lines) of the display.

Description has been briefly given of the difference between the operation principles of the conventional display and the display according to the present invention by referring to FIGS. 1A and 1B. Next, for easy understanding of the display according to the present invention, description will be given in detail of structure of a conventional display.

Figure 2A:
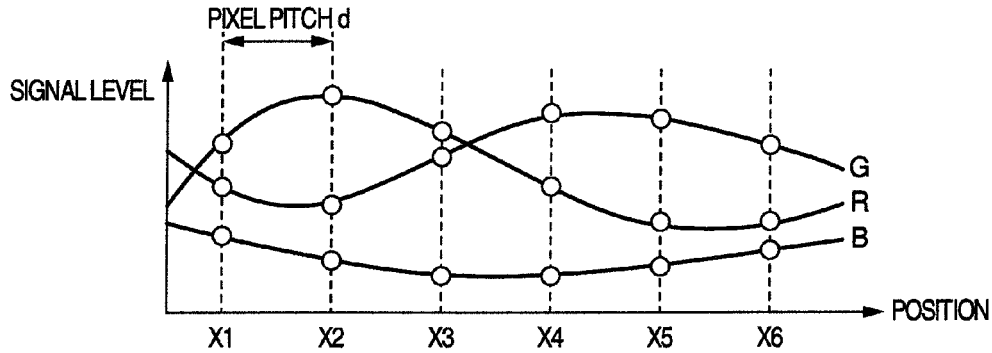
FIGS. 2A and 2B are diagrams to explain a concept of reduction display on a conventional display.
Figure 2B:
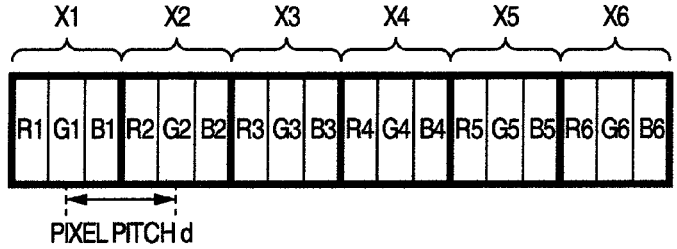

FIGS. 2A and 2B show a concept of the reduction display in the conventional display. Only the horizontal resolution conversion will be described for simplicity of explanation. According to the processing concept of the horizontal resolution conversion, the vertical resolution conversion can also be similarly achieved.

FIG. 2A shows an example of a spatial change of input display data in the horizontal direction. In FIG. 2A, the abscissa represents a position of the input display data in the horizontal direction. The ordinate represents a signal level of the input display data (or display data created by conducting up-sampling and filtering for the input display data) and indicates brightness with which data is to be displayed on the display. Each of the video signals respectively of red, green, and blue of which the levels change according to the horizontal position are sampled at an interval of pixel pitch d to thereby obtain signal intensity of subpixels for each of the pixels X1, X2, and so on.

FIG. 2B shows an example of an array of pixels in the horizontal direction (i.e., the row direction) in a display employing a stripe array. Pixels X1, X2, . . . are arranged at an interval of pixel pitch d, and each pixel Xi includes subpixels Ri, Gi, and Bi (i is a natural number). For each subpixel, lightness corresponding to the sampled signal intensity is used in the display operation to resultantly display a color image.

As above, the resolution is reduced by sampling the signal level of the input display data (or the display data created by conducting up-sampling and filtering for the input display data) at an interval of d.

Figure 3:
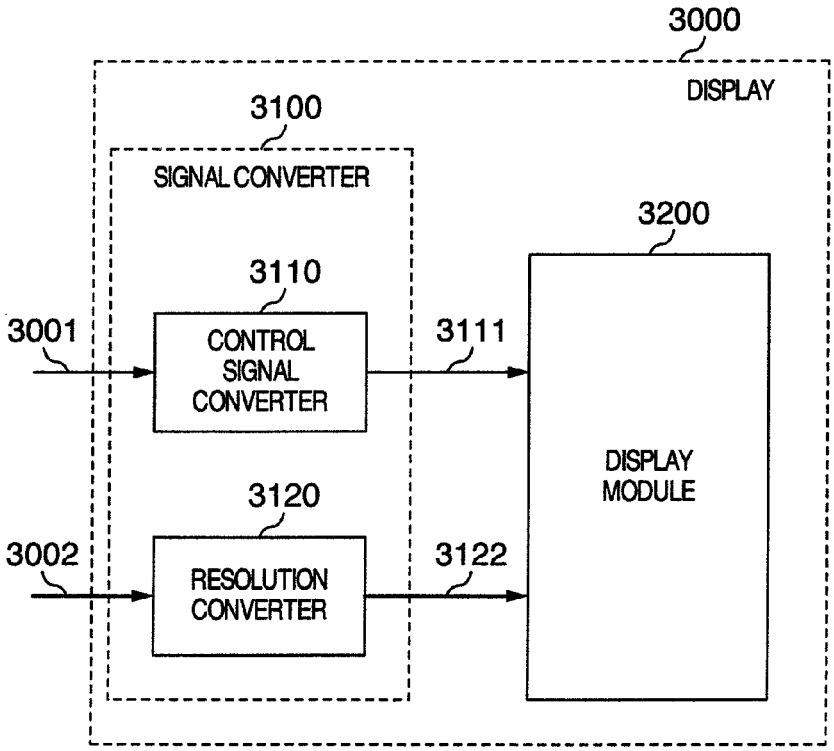
FIG. 3 is a block diagram showing structure of a conventional display.

FIG. 3 is a diagram showing a configuration of a conventional display. The display 3000 includes a signal converter 3100 and a display module 3200. The signal converter 3100 includes a control signal converter 3110 and a resolution converter 3120.

The signal converter 3100 receives as inputs thereto an input control signal 3001 and input display data 3002 to produce an output control signal 3111 and output display data 3122.

The resolution converter 3120 converts resolution of the input display data 3002. For example, if the data 3002 has a horizontal resolution of P pixels, the display module 3200 has a horizontal resolution of p pixels (i.e., the number of pixels), and P>p holds; the resolution converter 3120 conducts reduction with a multiplication factor of p/P. The rate conversion with of a multiplication factor of p/P is implemented, for example, as described in JP-A-2000-165664. That is, the input display data 3002 is up-sampled by multiplying the data by p, the resultant data is then filtered by suppressing various distortions of the data, and then the obtained data is down-sampled using a factor of 1/P.

The control signal converter 3110 processes the input control signal 3001 to create the output control signal 3111 synchronized with the output display data 3122.

The display module 3200 is a display panel including fixed pixels, for example, an LCD panel, an organic EL panel, a projection display panel, or an FED panel. The display module 3200 displays the output display data 3122 delivered from the resolution converter 3120, at timing synchronized with the output control signal 3111 produced from the control signal converter 3110.

Description has been given of the configuration of the conventional display. Description will next be given of the display according to the present invention.

Figure 4A:
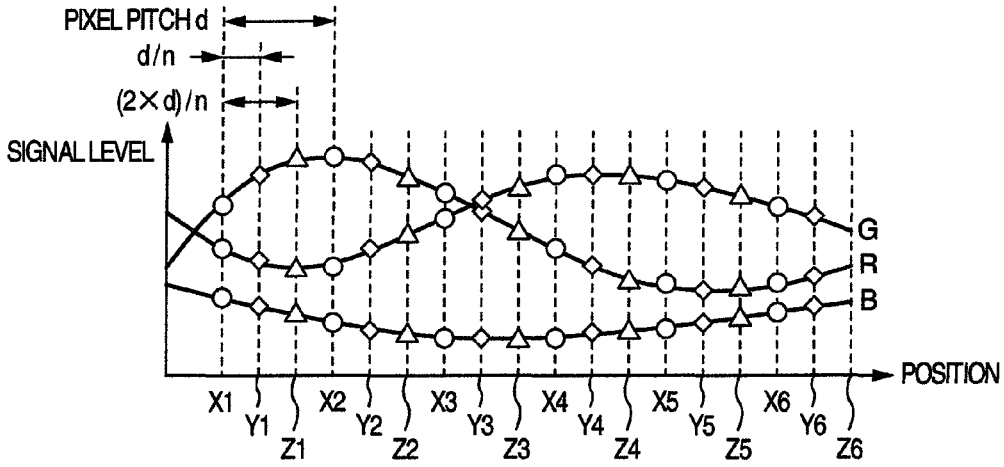
FIGS. 4A to 4D are diagrams to explain a concept of reduction display on a display according to the present invention.

FIGS. 4A to 4D are diagrams to explain a concept of the reduction display in the display according to the present invention. FIG. 4A shows an example of a spatial change of the input display data as in FIG. 2A. The abscissa of FIG. 4A represents the position of the input display data in the horizontal direction. The ordinate represents the signal level of the input display data (or display data created by conducting up-sampling and filtering for the input display data) and indicates brightness with which data is to be displayed on the display.

In FIG. 4A, each of the video signals respectively of red, green, and blue of which the levels change according to the horizontal position is sampled at an interval of pixel pitch d. In the operation, as distinct from the sampling in the conventional display in which the sampling position is fixed to the interval of pixel pitch d, the sampling position varies for each of the three subframes.

For example, in the first subframe, signal levels Ri, Gi, and Bi (i is a natural number) are sampled at positions X1, X2, and so on. In the second subframe, the signal levels Ri, Gi, and Bi are sampled at positions Y1, Y2, and so on. In the operation, the positions Xi and Yi are apart from each other by d/3. In the third subframe, the signal levels Ri, Gi, and Bi are sampled at positions Z1, Z2, and so on. The positions Xi and Zi are apart from each other by (2×d)/3 and the positions Yi and Zi are apart from each other by d/3.

In this way, the sampling position is not fixed according to the interval d, but is shifted in the subpixel unit for each subframe, and hence the amount of information items of signal level obtained by the sampling is increased. Additionally, by sampling the signal level of the input display data (or display data created by conducting up-sampling and filtering for the input display data) at an interval of d, the resolution is reduced.

Figure 4B:
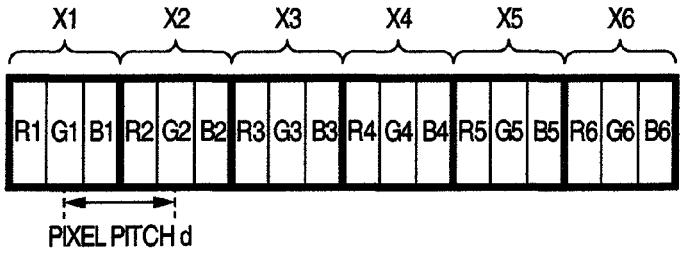
Figure 4C:
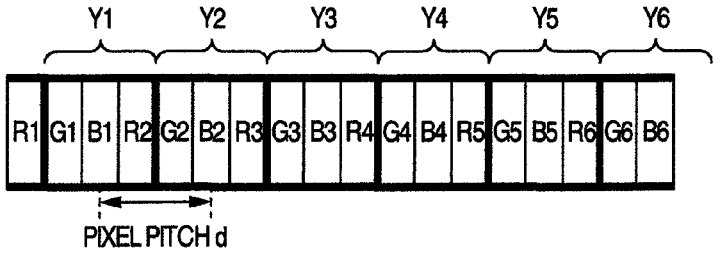
Figure 4D:
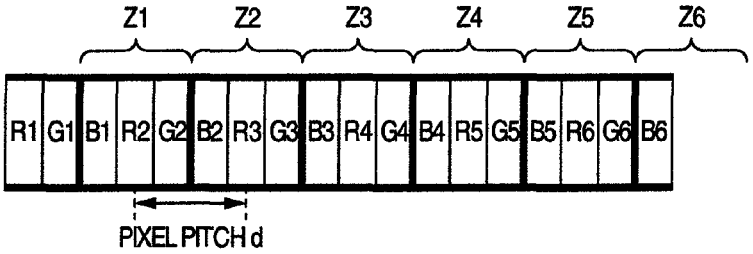

Referring now to FIGS. 4B to 4D, description will be given of the display data obtained as above. FIGS. 4B to 4D show examples of the pixel array in the horizontal (row) direction in a display including a stripe array according to the present invention.

In the conventional display shown in FIG. 2B, the three subpixels of each pixel are fixedly ordered, i.e., (R, G, B) in the combination thereof. According to the present invention, the order of the three subpixels of each pixel is changed for each subframe.

As FIG. 4B shows, in the first subframe, one pixel Xi includes three subpixels (Ri, Gi, Bi) to display images. In the second subframe, one pixel Yi includes three subpixels (Gi, Bi, Ri+1) to display images as shown in FIG. 4C. In the third subframe, one pixel Zi includes three subpixels (Bi, Ri+1, Gi+1) to display images as shown in FIG. 4D. In this way, the order of the three subpixels of each pixel is changed in the combination thereof (R, G, B) for each subframe corresponding to the signal level sampled for the subframe to resultantly display color images.

In the color display operation, by changing or rearranging the order of subpixels in the combination in association with the sampling position, the amount of displayable and spatial information items is increased. In the fixed-pixel display, it is possible to make the viewer perceive images with fineness equal to or more than that the fineness obtainable according to the number of pixels.

Figure 5:
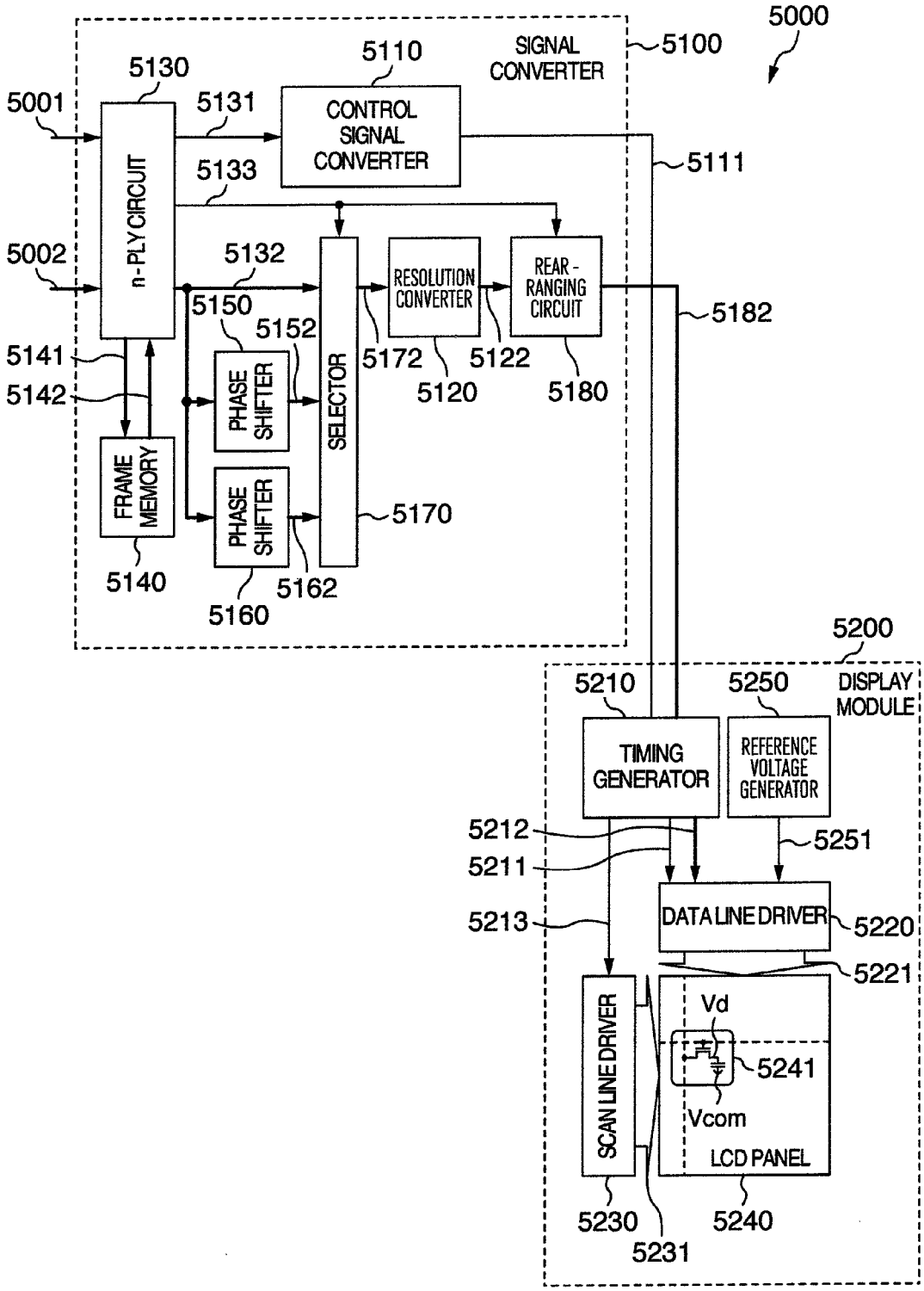
FIG. 5 is a block diagram showing structure of a display according to the present invention.

Referring now to FIG. 5, description will be given of a configuration of a display according to the present invention. In FIG. 5, the display 5000 includes a signal converter 5100 and a display module 5200. The signal converter 5100 converts input display data 5002 to display obtained data on the display module 5200. The input display data 5002 is produced, for example, by a set of signal processing circuits, not shown, of a television receiver and a video recording and reproducing unit or by a set of graphic processing circuits, not shown, of a Personal Computer (PC) and a cellular phone.

The display 5000 receives an input control signal 5001 together with the input display data 5002. The input control signal 5001 includes, for example, a vertical synchronizing signal defining one frame period (to display one screen) of the input display data 5002, a horizontal synchronizing signal defining one horizontal scan period (to display one line), a data valid period signal defining a valid period of the input display data 5002, and a reference clock signal synchronized with the data 5002. The input display data 5002 and input control signal 5001 are transferred from an external signal generator, not shown, to the display 5000. For this purpose, it is possible to employ various electric signals such as signals of Low Voltage Differential Signaling (LVDS), Complementary Metal-Oxide Semiconductor (CMOS), and Low Voltage Transistor-Transistor Logic (LVTTL) levels.

The signal converter 5100 converts the resolution of the input display data 5002 to create output display data 5182 and sends the data 5182 to the display module 5200. The converter 5100 includes an n-ply circuit 5130, a frame memory 5140, phase shifters 5150 and 5160, a selector 5170, a resolution converter 5120, a rearranging circuit 5180, and a control signal converter 5110.

The n-ply circuit 5130 processes the frame frequency of the input display data 5002 to multiply the frequency by a factor of n and creates n-ply display data 5132 having the n-ply frame frequency. Also, the circuit 5130 sequentially stores the input display data 5002 in the frame memory 5140. In an operation to read data of one frame from the memory 5140, the n-ply circuit 5130 reads the one-frame data within a period of time obtained by dividing one frame period by n. By conducting the read operation n times during the one-frame period, the frame frequency is multiplied by n.

The frame memory 5140 is a storage device having a storage capacity capable of storing at least one frame of display data. The memory 5140 writes therein the input display data 5002, and reads therefrom the n-ply display data 5132. As the frame memory 5140, there may be used, for example, various kinds of Dynamic Random Access Memories (DRAM). Reference numerals 5141 and 5142 respectively indicate write data in and readout data from the frame memory 5140.

Additionally, the n-ply circuit 5130 creates an n-ply control signal 5131 and a subframe identification signal 5133. The n-ply control signal 5131 includes, for example, an n-ply vertical synchronizing signal defining one subframe period, an n-ply horizontal synchronizing signal defining one horizontal scan period, an n-ply display data valid period signal defining the valid period of the n-ply display data 5132, and n-ply clock signal synchronized with the n-ply display data 5132. The subframe identification signal 5133 is synchronized with the n-ply display data 5132 and is used to identify the sequential number assigned to a subframe associated with the n-ply display data 5132.

The phase shifters 5150 and 5160 shift the phase of the n-ply display data 5132. Specifically, the phase shifter 5150 shifts the phase by d/n and the phase shifter 5160 shifts the phase by (2×d)/n. As a result of the shift operation, there are obtained the n-ply display data 5132 for the first subframe, the n-ply display data 5152 for the second subframe, and the n-ply display data 5162 for the third subframe.

From the n-ply display data 5132, the n-ply display data 5152, and the n-ply display data 5162, the selector 5170 selects n-ply display data corresponding to an associated subframe on the basis of the subframe identification signal 5133 and outputs the signal therefrom as selected n-ply display data 5172.

The resolution converter 5120 converts the n-ply display data 5172 selected by the selector 5170 into converted resolution display data 5122. Assume that, for example, the input display data 5002 has a horizontal resolution (i.e., the number of pixels) of P pixels, the display module 5200 has a horizontal resolution of p pixels, and a relationship of P>q holds. Then, the resolution converter 5120 conducts the reduction processing on the basis of a rate conversion factor of p/P.

The p/P rate conversion is conducted, for example, as described in JP-A-2000-165664. That is, display data is up-sampled by multiplying the data by p, the resultant display data is appropriately filtered by suppressing occurrence of various distortions, and then the obtained display data is down-sampled by dividing the data by P. Any other appropriate method may also be used for the resolution conversion.

In the display data 5172 for the resolution conversion, the phase varies between the subframes due to the operation of the phase shifters 5150 and 5160 and the selector 5170. The operation corresponds to the sampling at position Xi of the first subframe, the sampling at position Yi of the second subframe, and the sampling at position Zi of the third subframe.

The rearranging circuit 5180 receives the converted resolution display data 5122 from the resolution converter 5120 and converts the data 5122 by rearranging the order of subpixels (in the subpixel array) according to the subframe identification signal 5133 to produce output display data 5182. The processing above corresponds to the processing to change the first subpixel array in the first subframe, the second subpixel array in the second subframe, and the third subpixel array in the third subframe for each subframe as shown in FIGS. 4B to 4C.

The control signal converter 5110 processes the n-ply control signal 5131 to create an output control signal 5111 synchronized with the output display data 5182. The output control signal 5111 includes, for example, a vertical synchronizing signal defining one subframe period (to display one screen) of the output display data 5182, a horizontal synchronizing signal defining one horizontal scan period (to display one line), a data valid period signal defining a valid period of the output display data 5182, and a reference clock signal synchronized with the data 5182.

The display module 5200 is a display panel including fixed pixels, for example, an LCD panel, an organic EL panel, a projection display panel, or an FED panel. Although the display module 5200 is employed in this example, there may be used any appropriate display device.

The display module 5200 includes a timing generator 5210, a data line driver 5220, a scan line driver 5230, an LCD panel 5240, and a reference voltage generator 5250.

The timing generator 5210 receives the output control signal 5111 and the output display data 5182 sent from the signal converter 5100. Using the signal 5111 and the data 5182, the timing generator 5210 creates a data line driver control signal 5211 to control the data line driver 5220 and data line drive display data 5212 and a scan line driver control signal 5213 to control the scan line driver 5230.

The data line driver control signal 5211 includes, for example, an output timing signal defining output timing of a data voltage, an alternation signal to determine polarity of a source voltage on the basis of the data line drive display data 5212, and a clock signal synchronized with the display data. The scan line driver control signal 5213 includes, for example, a shift signal defining a scan period of one line and a vertical start signal defining a scan start point of a first line. Reference numerals 5250 and 5251 respectively indicate a reference voltage generator and a reference voltage.

The data line driver 5220 generates a voltage corresponding to the number assigned to a display gradation or a grey scale level by use of the reference voltage 5251 and selects a voltage of one level corresponding to the data line drive display data 5212 to output a data voltage 5221 to be applied to the LCD panel 5240.

The scan line driver 5230 creates a scan line selection signal 5231 using the scan line driver control signal 5213 to output the signal 5231 to the display panel 5240.

In the panel 5240, one subpixel includes a Thin Film Transistor (TFT) including a source electrode, a gate electrode, and a drain electrode; a liquid crystal layer, and electrodes opposing to each other. When a scan signal is applied to the gate electrode, the TFT conducts a switching operation. In the on state of the TFT, the data voltage written via the source electrode in the drain electrode connected to a first surface of the liquid crystal layer. In the off state of the TFT, the voltage written in the drain electrode is kept retained. Assume that the voltage on the drain electrode is Vd and the opposing electrode voltage is VCOM. The liquid crystal layer changes the direction of polarization based on the voltage difference between Vd and VCOM. Light from a backlight disposed on the rear side passes through polarizing plates disposed on the upper and lower sides of the liquid crystal layer such that the amount of the light from the backlight is changed to resultantly achieve gray-scale display.

Figure 6:
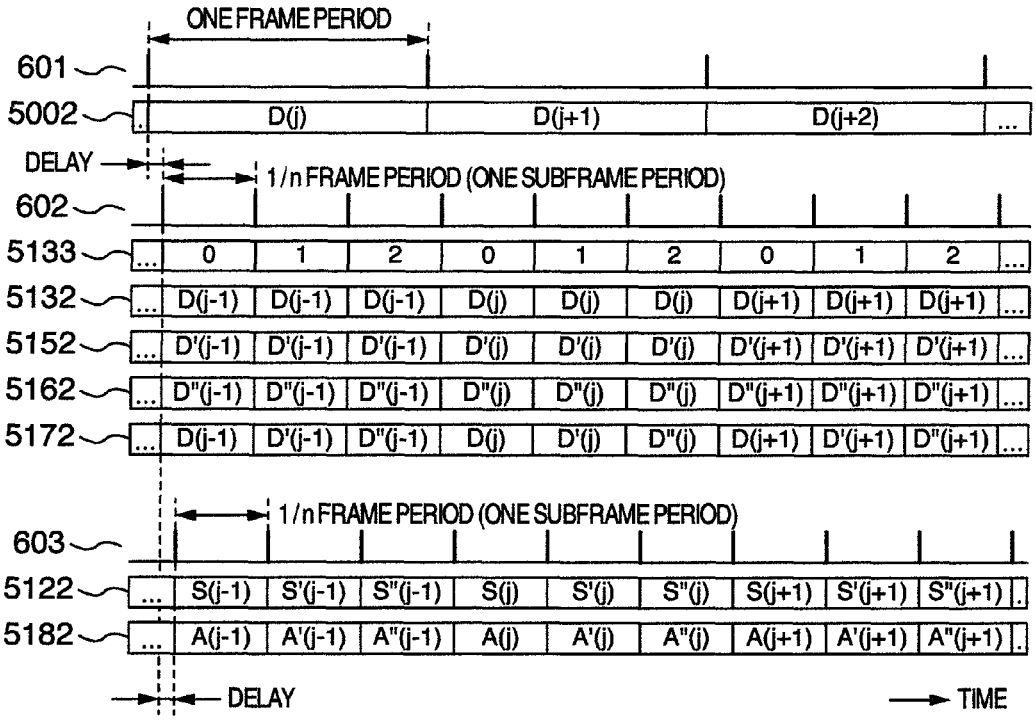
FIG. 6 is a signal timing chart to explain operation in a display according to the present invention.

Referring next to FIG. 6, description will be given of operation of the display according to the present invention. FIG. 6 is a signal timing chart of operation shown in FIG. 5. In FIG. 6, the abscissa represents a lapse of time. As FIG. 5 shows, an external signal generator, not shown, supplies input display data 5002 and an input control signal 5001 to the signal converter 5100. In FIG. 6, there are shown an input vertical synchronizing signal 601 included in the input control signal 5001 and the input display data 5002. The sync signal 601 is a signal defining one frame period of the input display data 5002, specifically, a pulse synchronized with a change of frames of the data 5002.

In FIG. 6, D(j) indicates input display data of the j-th frame (j is a natural number). Similarly, for example, D(j+1) indicates input display data of the (j+1)-th frame. For the input display data 5002, data of each frame is sequentially inputted for each associated frame period, i.e., D(j), D(j+1), D(j+2), and so on.

Next, the n-ply circuit 5130 shown in FIG. 5 executes n-ply processing. FIG. 6 shows an n-ply vertical synchronizing signal 602 included in the n-ply control signal 5131 created by the n-ply circuit 5130, an n-ply display data 5132, and a subframe identification signal 5133. The vertical synchronizing or sync signal 602 defines one subframe period (i.e., 1/n frame period) of the data 5132 and is a pulse synchronized with a change of the subframe of the display data 5132. As FIG. 6 shows, between the combination of the input vertical sync signal 601 and the input display data 5002 and the combination of the n-ply vertical sync signal 602 and the n-ply display data 5132, there generally occurs a delay due to the n-ply processing.

The n-ply circuit 5130 processes the input control signal 5001 to create a subframe identification signal 5133. The signal 5133 is used to identify a subframe of the n-ply display data 5132. The embodiment shows an example in which the number of subpixels is three, i.e., n=3. Specifically, one frame of the input display data 5002 is divided into three subframes including the first to third subframes. Therefore, it is possible to construct the subframe identification signal 5133, for example, by a counter which sequentially counts 0, 1, and 2. FIG. 6 shows an example in which counter values of 0, 1, and 2 are assigned to the first, second, and third subframes, respectively. However, the present invention is not restricted by the example.

Next, the phase shifters 5150 and 5160, the selector 5170, and the resolution converter 5120 shown in FIG. 5 convert resolution for the n-ply display data 5132. The selector 5170 receives as inputs thereto the subframe identification signal 5133, the n-ply display data 5132 for the first subframe, the phase-shifted n-ply display data 5152 for the second subframe, and the phase-shifted n-ply display data 5162 for the third subframe, and then selects therefrom selected n-ply display data 5172 corresponding to the associated subframe on the basis of the frame identification signal 5133.

In FIG. 6, D'(j) indicates the phase-shifted n-ply display data 5152 obtained by conducting a phase shift operation for the second subframe for the n-ply display data D(j) of the j-th frame and D"(j) indicates the phase-shifted n-ply display data 5162 obtained by conducting a phase shift operation for the third subframe for the n-ply display data D(j) of the j-th frame.

Thereafter, the rearranging circuit 5180 shown in FIG. 5 rearranges the subpixel array in the selected n-ply display data 5172 according to the frame identification signal 5133 to create output display data 5182. The control signal converter 5110 processes the n-ply control signal 5131 to create therefrom an output display control signal 5111.

FIG. 6 shows a vertical synchronizing signal 603 included in the output control signal 5111, the signal 603 defining one subframe period of the output display data 5182. In FIG. 6, S(j) indicates converted resolution display data obtained by converting resolution for the n-ply display data of the first subframe of the j-th frame, S'(j) indicates converted resolution display data obtained by converting resolution for the phase-shifted n-ply display data of the second subframe of the j-th frame, and S"(j) indicates converted resolution display data obtained by converting resolution for the n-ply display data of the third subframe of the j-th frame.

Similarly, A(j) indicates output display data of the first subframe of the j-th frame, A'(j) indicates output display data of the second subframe of the j-th frame, and A"(j) indicates output display data of the third subframe of the j-th frame. As FIG. 6 shows, between the combination of the n-ply vertical sync signal 602 and the n-ply display data 5132 and the combination of the output vertical sync signal 603 and the output display data 5182, there generally occurs a delay due to various data conversion processings.

Figure 7A:
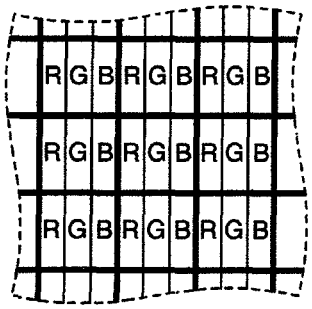
FIGS. 7A to 7C are diagrams showing examples of an array in which one pixel includes three subpixels.
Figure 7B:
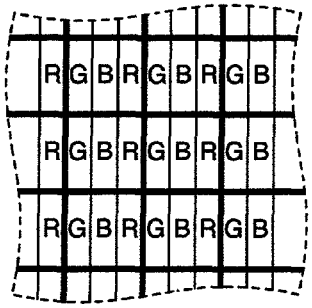
Figure 7C:
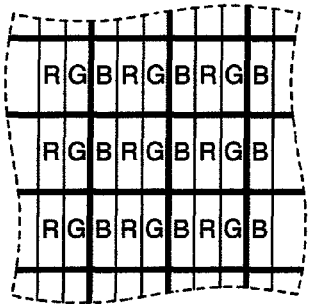

FIGS. 7A to 7C show examples of a subpixel array in the display according to the present embodiment. In a magnified part of the display panel, each frame enclosed by bold lines indicates one pixel including three subpixels having an equal area. FIGS. 7A to 7C show configurations of pixels having respective subframes at one and the same position of one and the same display. FIG. 7A shows a subpixel configuration in the first subframe in which one pixel includes an array of three subpixels, i.e., R, G, and B subpixels having an equal area. FIG. 7B shows a subpixel configuration in the second subframe in which one pixel includes an array of three subpixels, i.e., G, B, and R subpixels having an equal area. FIG. 7C shows a subpixel configuration in the third subframe in which one pixel includes an array of three subpixels, i.e., B, R, and G subpixels having an equal area. In this way, the first to third subframes differ from each other in the arrangement of subpixels. It is to be understood that the display order of subframes and the order of arrangement of subpixels in each row are not restricted by the example shown in FIG. 7.

Second Embodiment

Figure 8A:
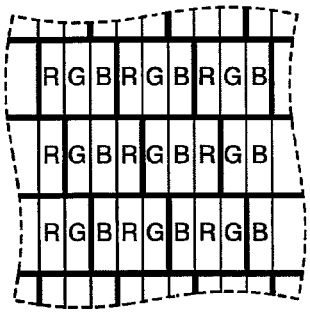
FIGS. 8A to 8C are diagrams showing examples of an array in which one pixel includes three subpixels.
Figure 8B:
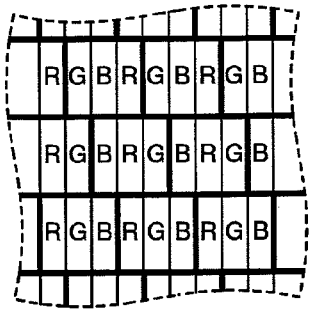
Figure 8C:
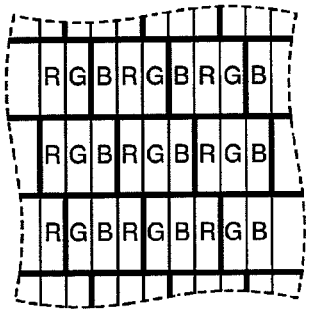
Figure 9A:
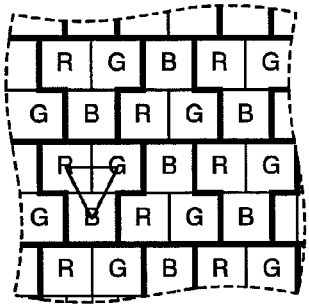
FIGS. 9A to 9F are diagrams showing examples of an array in which one pixel includes three subpixels.
Figure 9D:
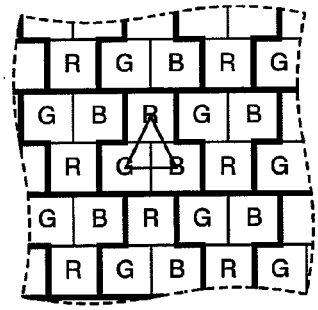
Figure 9B:
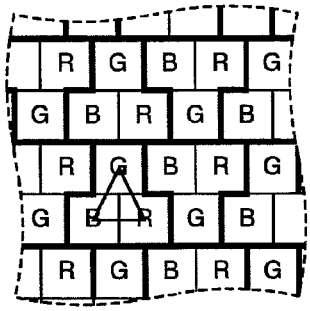
Figure 9E:
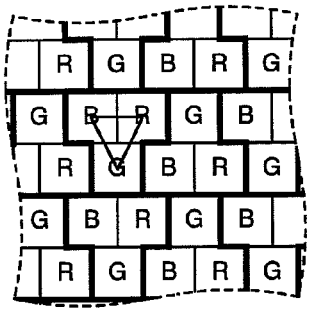
Figure 9C:
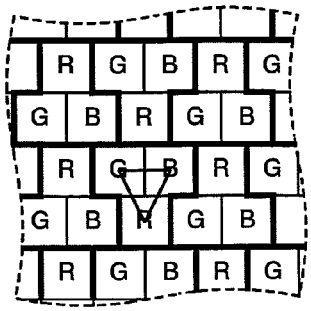
Figure 9F:
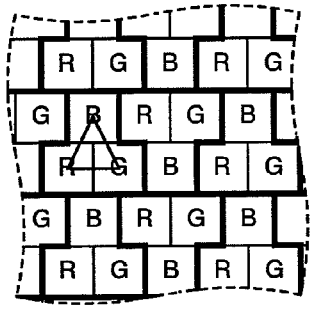
Figure 10A:
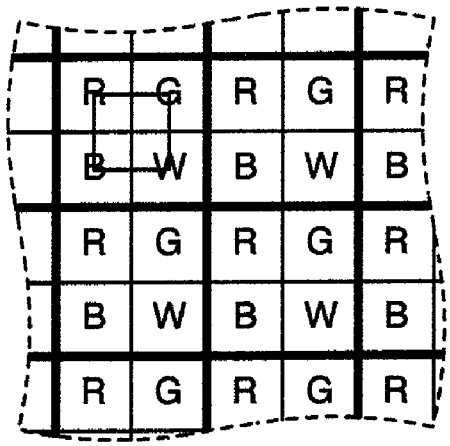
FIGS. 10A to 10D are diagrams showing examples of an array in which one pixel includes four subpixels.
Figure 10C:
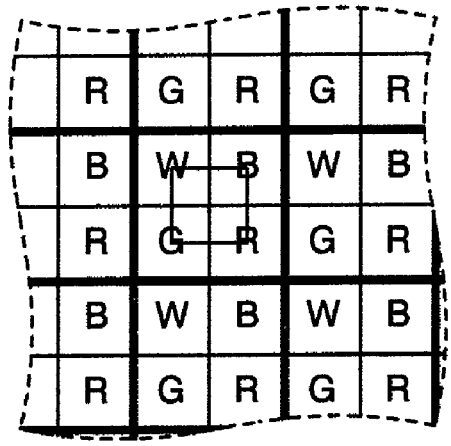
Figure 10B:
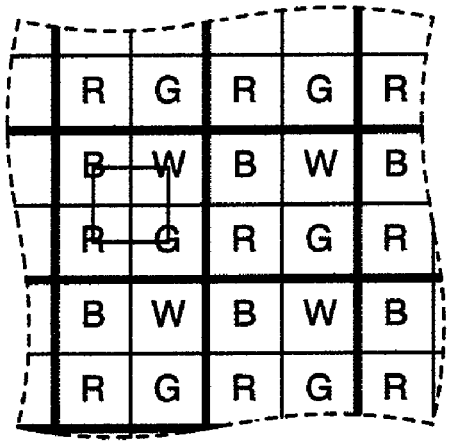
Figure 10D:
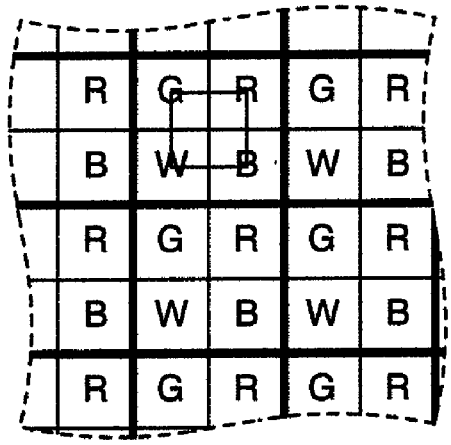
Figure 11A:
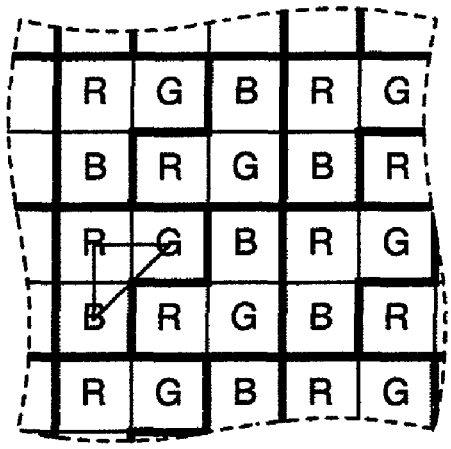
FIGS. 11A to 11F are diagrams showing examples of an array in which one pixel includes three subpixels.
Figure 11D:
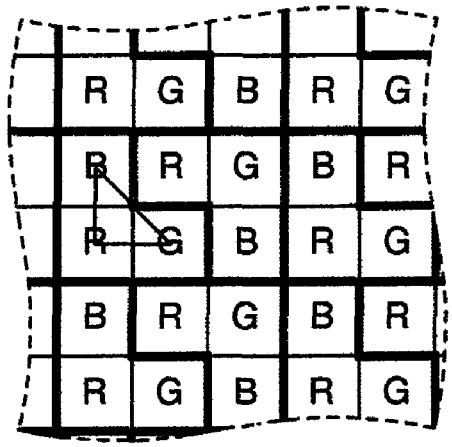
Figure 11B:
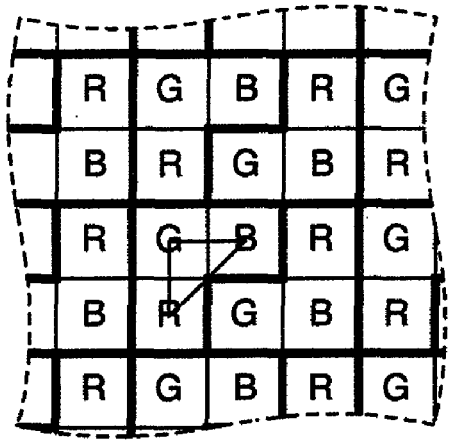
Figure 11E:
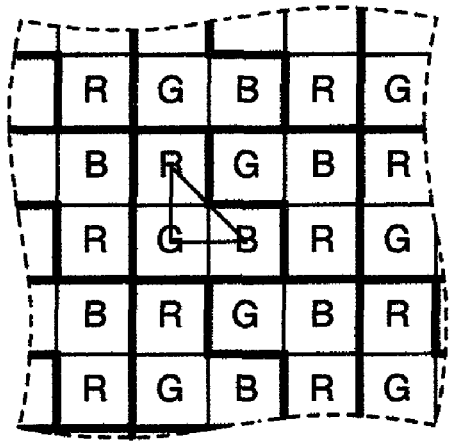
Figure 11C:
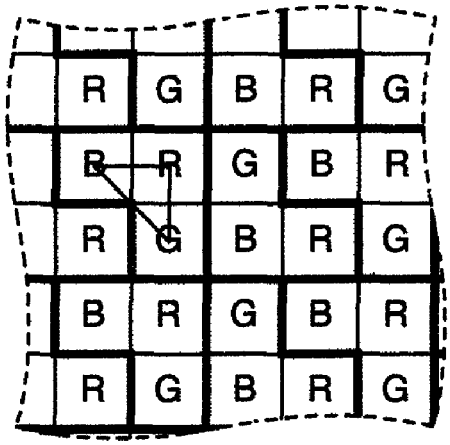
Figure 11F:
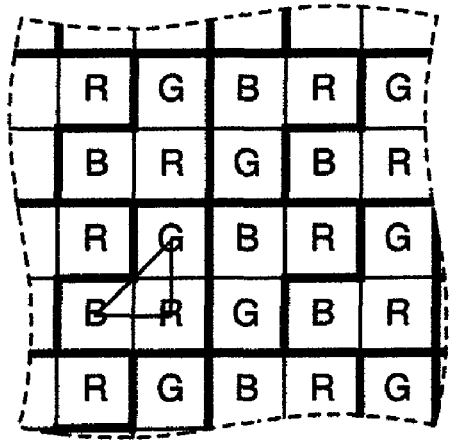

FIGS. 8A to 8C show examples of a subpixel array in the display according to the present invention. In a magnified part of the display panel, each frame enclosed by bold lines indicates one pixel including three subpixels having an equal area. FIGS. 7A to 7C show configurations of pixels having respective subframes at one and the same position of one and the same display. FIG. 8A shows a subpixel configuration in the first subframe. In the first row, one pixel includes an array of R, G, and B subpixels having an equal area. In the second row, one pixel includes an array of G, B, and R subpixels having an equal area. In the third row, one pixel includes an array of B, R, and G subpixels having an equal area. In the fourth and subsequent rows, the three rows described above are repeatedly arranged. FIG. 8B shows a subpixel configuration in the second subframe in which one pixel includes an array of subpixels, the array differing from that of FIG. 8A in the arrangement order of subpixels for each row. FIG. 8C shows a subpixel configuration in the third subframe in which one pixel includes an array of subpixels, the array differing from those of FIGS. 8A and 8B in the arrangement order of subpixels for each row.

In FIG. 7, the subpixel array is kept unchanged in each row of each subframe. In FIG. 8, distinct from FIG. 7, the subpixel array varies between the rows of each subframe. The subframe display order, the order of arrangement of subpixels in each row, and the subpixel array order in each row are not restricted by the example shown in FIG. 8. The configuration and operation of the constituent components other than the subpixel array are substantially equal to those of the display described by referring to the first embodiment, and hence description thereof will be avoided.

FIGS. 9A to 9F show examples of the subpixel array in the embodiment according to the present invention. In a magnified part of the display panel, each frame enclosed by bold lines indicates one pixel including three subpixels having an equal area. In this example, the present invention is applied to a display including a delta-nabla array in which the pixels are shifted by 0.5 subpixel in each row.

In the display employing the delta-nabla array, there exist six types of subpixel arrays. FIGS. 9A to 9F are such six subpixel arrays at one and the same position in one and the same device. In the third embodiment, the number of subframes is, for example, a value obtained by multiplying the number of subpixels (n=3) by two (=6), and the arrays shown in FIGS. 9A to 9F are allocated to the respective subframes. The resolution converter is adjusted to sample data at a position of the center of gravity of each pixel.

As can be seen from FIGS. 9A to 9F, in the display using the delta-nabla array, the position of the center of gravity varies in the six types of pixels not only in the horizontal direction but also in the vertical direction. That is, by applying the present invention to the display employing the delta-nabla array, it is possible to improve the fineness of images in the horizontal direction as well as in the vertical direction.

The subframe display order and the subpixel array order in each row are not restricted by the example shown in FIGS. 9A to 9F. The configuration and operation of the constituent components other than the subpixel array are substantially equal to those of the display described by referring to the first embodiment, and hence description thereof will be avoided.

Fourth Embodiment

FIGS. 10A to 10D show examples of the subpixel array in the embodiment according to the present invention. In a magnified part of the display panel, each frame enclosed by bold lines indicates one pixel including four subpixels having an equal area. In this example, the present invention is applied to a display including an RGBW array in which white (W) pixels are added to the red, green, and blue pixels.

In the RGBW array display, there exist four kinds of subpixel arrays. FIGS. 10A to 10D are such four subpixel arrays at one and the same position in one and the same display. In the fourth embodiment, the number of subframes is, for example, the number of subpixels (n=4), and the arrays shown in FIGS. 10A to 10D are allocated to the respective subframes. The resolution converter is adjusted to sample data at a position of the center of gravity of each pixel.

As can be seen from FIGS. 10A to 10D, in the display using the RGBW array, the position of the center of gravity varies in the four types of pixels not only in the horizontal direction but also in the vertical direction. That is, by applying the present invention to the display employing the RGBW array, it is possible to improve fineness of images in the horizontal direction as well as in the vertical direction.

The subframe display order and the subpixel array order in each row are not restricted by the example shown in FIGS. 10A to 10D. The configuration and operation of the constituent components other than the subpixel array are substantially equal to those of the display described by referring to the first embodiment, and hence description thereof will be avoided.

Fifth Embodiment

FIGS. 11A to 11F show examples of the subpixel array in the embodiment according to the present invention. In a magnified part of the display panel, each frame enclosed by bold lines indicates one pixel including three subpixels having an equal area. In the example, the present invention is applied to a display including an L-shape array including pixels in which each combination of R, G, and B subpixels is formed in an L shape or in an inverse L shape.

In the display including an L-shape array, there exist six kinds of subpixel arrays. FIGS. 11A to 11F are such six subpixel arrays at one and the same position in one and the same display. In the fifth embodiment, the number of subframes is a value obtained by multiplying the number of subpixels (n=3) by two (=6), and the arrays shown in FIGS. 11A to 11F are allocated to the respective subframes. The resolution converter is adjusted to sample data at a position of the center of gravity of each pixel.

As can be seen from FIGS. 11A to 11F, in the display using the L-shape array, the position of the center of gravity varies in the six types of pixels not only in the horizontal direction but also in the vertical direction. That is, by applying the present invention to the display employing the L-shape array, it is possible to improve fineness of images in the horizontal direction as well as in the vertical direction.

The subframe display order and the subpixel array order in each row are not restricted by the example shown in FIGS. 11A to 11F. The configuration and operation of the constituent components other than the subpixel array are substantially equal to those of the display described by referring to the first embodiment, and hence description thereof will be avoided.

Sixth Embodiment

Figure 12A:
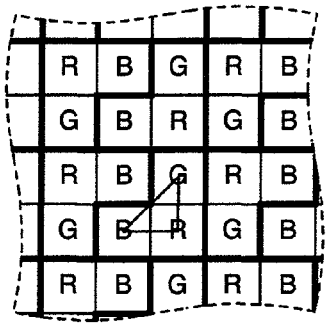
FIGS. 12A and 12B are diagrams showing examples of an array in which one pixel includes three subpixels.
Figure 12B:
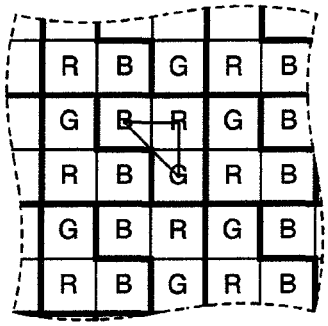

FIGS. 12A and 12B show examples of the subpixel array in the embodiment according to the present invention. In a magnified part of the display panel, each frame enclosed by bold lines indicates one pixel including three subpixels having an equal area. In the example, the present invention is applied to a display including an L-shape array including pixels in which each combination of R, G, and B subpixels is formed in an L shape or in an inverse L shape. The display differs from that shown in FIGS. 11A to 11F in that the B subpixels are linearly arranged in associated columns.

In the display including an L-shape array, there exist two kinds of subpixel arrays. FIGS. 12A and 12B are such two subpixel arrays at one and the same position in one and the same display. In the sixth embodiment, the number of subframes is, for example, two and the arrays shown in FIGS. 12A and 12B are allocated to the respective subframes. The resolution converter is adjusted to sample data at a position of the center of gravity of each pixel.

As can be seen from FIGS. 12A and 12B, in the display using the L-shape array, the position of the center of gravity varies in the two types of pixels not only in the horizontal direction but also in the vertical direction. That is, by applying the present invention to the display employing the L-shape array, it is possible to improve fineness of images in the horizontal direction as well as in the vertical direction.

The subframe display order and the subpixel array order in each row are not restricted by the example shown in FIGS. 12A and 12B. The configuration and operation of the constituent components other than the subpixel array are substantially equal to those of the display described by referring to the first embodiment, and hence description thereof will be avoided.

Seventh Embodiment

Figure 13A:
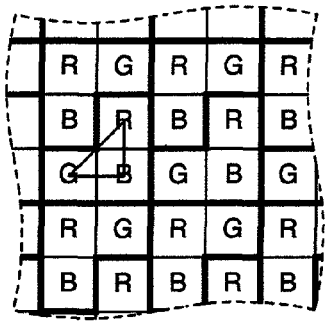
FIGS. 13A to 13F are diagrams showing examples of an array in which one pixel includes three subpixels.
Figure 13D:
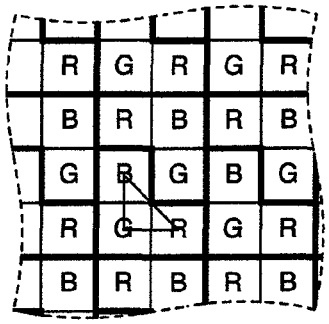
Figure 13B:
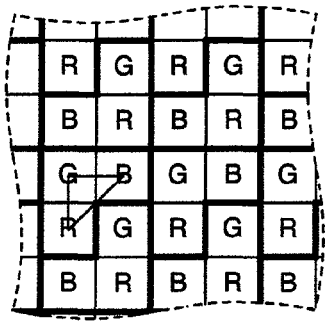
Figure 13E:
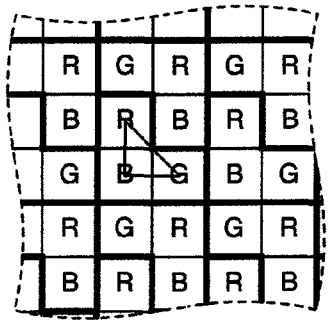
Figure 13C:
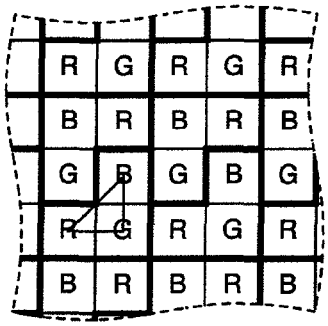
Figure 13F:
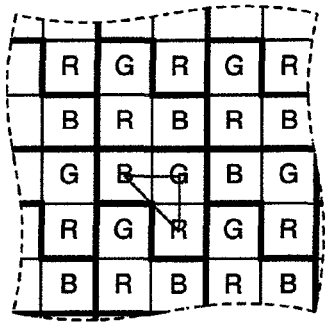

FIGS. 13 to 13F show examples of the subpixel array in the embodiment according to the present invention. In a magnified part of the display panel, each frame enclosed by bold lines indicates one pixel including three subpixels having an equal area. In the example, the present invention is applied to a display including an L-shape array including pixels in which each combination of R, G, and B subpixels is formed in an L shape or in an inverse L shape. The display differs from that shown in FIGS. 11A to 11F in the subpixel array and the combination of subpixels. Specifically, while in the display shown in FIGS. 11A to 11F, subpixels of (two rows) by (three columns) constitute two pixels; in the display shown in FIGS. 13A to 13F, subpixels of (three rows) by (two columns) constitute two pixels.

In the display including an L-shape array, there exist six kinds of subpixel arrays. FIGS. 13A to 13F are such six subpixel arrays at one and the same position in one and the same display. In the seventh embodiment, the number of subframes is, for example, a value obtained by multiplying the number of pixel (n=3) by two (=6) and the arrays shown in FIGS. 13A to 13F are allocated to the respective subframes. The resolution converter is adjusted to sample data at a position of the center of gravity of each pixel.

As can be seen from FIGS. 13A to 13F, in the display using the L-shape array, the position of the center of gravity varies in the six kinds of pixels not only in the horizontal direction but also in the vertical direction. That is, by applying the present invention to the display employing the L-shape array, it is possible to improve fineness of images in the horizontal direction as well as in the vertical direction.

The subframe display order and the subpixel array order in each row are not restricted by the example shown in FIGS. 13A to 13F. The configuration and operation of the constituent components other than the subpixel array are substantially equal to those of the display described by referring to the first embodiment, and hence description thereof will be avoided.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device, comprising:

a display panel including a plurality of pixels, each of the pixels including a set of n subpixels;

a data line driver unit configured to output to the pixels a display signal corresponding to display data;

a scan line driver unit configured to produce a selection signal configured to sequentially select pixels; and a signal converter unit, including:

(a) an n-ply unit configured to process a frame of input display data inputted thereto, and configured to produce therefrom n subframes;

(b) a plurality of phase shifting units, each configured to shift the phase of an n subframe by an amount different than any other phase shifting unit;

(c) a selector configured to sequentially select the n subframes having mutually different phases;

(d) a resolution converter unit configured to convert a resolution of each of the n subframes thus sequentially selected; and (e) a rearranging unit configured to rearrange a combination of n subpixels included in each pixel of the n subframes thus converted, in n ways corresponding to the n subframes.

2. A display device according to claim 1, wherein the combination of the subpixels rearranged by the rearranging unit differs for respective display areas corresponding to the n subframes.

3. A display device according to claim 1, wherein the set of n subpixels includes n colors, and wherein the n subpixels are arranged in a lattice shape.

4. A display device according to claim 1, wherein the set of n subpixels includes n colors, and wherein the n subpixels are arranged with a shift of half of a subpixel for each row or column.

5. A display device according to claim 1, wherein the pixel includes at least four subpixels, the at least four subpixels being arranged in a lattice shape.

6. A display device according to claim 1, wherein the pixel includes at least three subpixels, the at least three subpixels being arranged in an L shape.

7. A display device according to claim 6, wherein:

subpixels having at least one of the three colors selected from the at least three subpixels are linearly arranged; and the array of the at least three subpixels is rearranged in two ways corresponding to two subframes.

8. A display device according to claim 6, wherein the display panel comprises:

a first pixel, having an L shape, and including the at least three subpixels arranged in an L shape; and a second pixel, having a shape of an inverse L, and including at least three subpixels arranged in an inverse L shape, the second pixel being paired with the first L-shaped pixel;

wherein the first L-shaped pixel and the second L-shaped pixel are arranged adjacent to each other in a direction of a row of the display panel, in order to form a lattice having: two rows by three columns, or a plurality thereof.

9. A display device according to claim 6, wherein the display panel comprises:

a first pixel, having an L shape, and including at least three subpixels arranged in an L shape; and a second pixel, having a shaped of an inverse L, and including at least three subpixels arranged in an inverse L shape, the second pixel being paired with the first L-shaped pixel;

wherein the first L-shaped pixel and the second L-shaped pixel are arranged adjacent to each other in a direction of a row of the display panel, in order to form a lattice having: three rows by two columns, or a plurality thereof.

10. A display device according to claim 1, wherein the n subpixels included in the pixel are substantially equal to each other in area.

* * * * *